United States Patent [19]

Oakland et al.

[11] 4,038,619

[45] July 26, 1977

[54] PNEUMATIC TIMER

[75] Inventors: Frederic Oakland, Hales Corners; Edward A. Mallonen, New Berlin, both of Wis.

[73] Assignee: Cutler-Hammer, Inc., Milwaukee, Wis.

[21] Appl. No.: 618,579

[22] Filed: Oct. 1, 1975

[51] Int. Cl.[2] ..... H01H 7/03

[52] U.S. Cl. ..... 335/61; 200/34; 200/83 T

[58] Field of Search ..... 335/59, 60, 61, 63, 335/67; 200/34, 83 T

[56] References Cited

U.S. PATENT DOCUMENTS

| | | | |
|---|---|---|---|
| 2,899,523 | 8/1959 | Flatet et al. | 200/34 X |
| 3,509,501 | 4/1970 | Brovedan | 335/61 |
| 3,585,321 | 6/1971 | Dennison | 200/34 |
| 3,684,985 | 8/1972 | Flanagan | 335/61 |
| 3,737,596 | 6/1973 | Yokoyama | 200/34 |

FOREIGN PATENT DOCUMENTS

| | | | |
|---|---|---|---|
| 278,348 | 5/1965 | Australia | 200/83 T |

*Primary Examiner*—George Harris
*Attorney, Agent, or Firm*—Hugh R. Rather; William A. Autio; Michael E. Taken

[57] ABSTRACT

A pneumatic timer translating the external force of an electromagnetic relay or the like into rotational movement of a camshaft to actuate a set of switch contacts. The rotation of the camshaft is retarded in one direction by an adjustable pneumatic one-way time delay mechanism. The timer is capable of two modes of operation, on delay and off delay, according to choice of camshaft configuration and orientation.

5 Claims, 10 Drawing Figures

PNEUMATIC TIMER

BACKGROUND OF THE INVENTION

In certain switching installations it is desirable to have a time delay period between the operator movement and the controlling contact function. This may be accomplished by the use of an auxiliary device mounted to an electromagnetic relay or the like to provide a time delay between the energization of the relay and the switching operation of a set of contacts in the auxiliary device.

OBJECTS OF THE INVENTION

An object of the invention is to provide an improved pneumatic timer.

Another object of the invention is to provide a pneumatic timer having translational operation by means of a force translating camshaft.

Another object of the invention is to provide a pneumatic timer convertible between an off delay mode and an on delay mode.

Another object of the invention is to provide a pneumatic timer of the aforementioned character having an adjustable amount of timed delay.

Another object of the invention is to provide an pneumatic timer of the aforementioned character having improved diaphragm means.

Other objects and advantages of the invention will hereinafter appear.

DESCRIPTION OF THE PREFERRED EMBODIMENT

Figure 1:
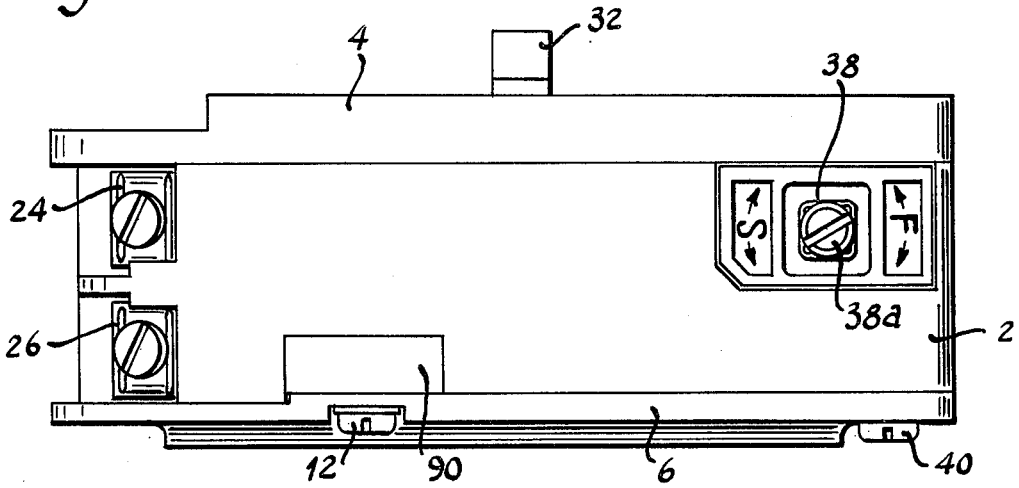
FIG. 1 is a top plan view of a timer constructed in accordance with the invention.
Figure 2:
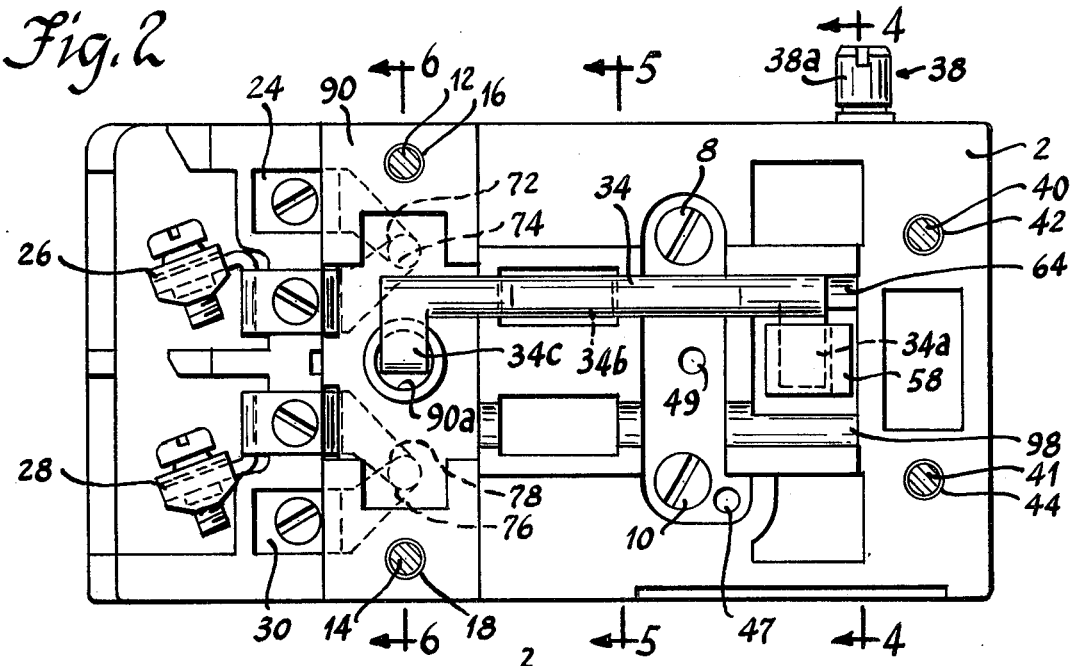
FIG. 2 is a front view of the embodiment shown in FIG. 1 with the front cover removed to show an "on delay" timing mode.
Figure 3:
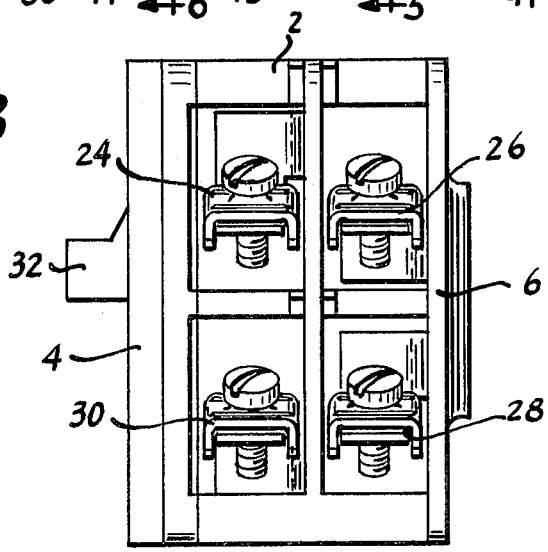
FIG. 3 is an end view of the embodiment shown in FIG. 1.

As shown in FIGS. 1–3, the timer is provided with a generally rectangular insulating base 2 closed on each side by an insulating back cover 4 and an insulating front cover 6. As shown in FIG. 2, screws 8 and 10 extend through the base and the back cover and thread into nuts (not shown) seated in the back cover for mounting the same to the base. Screws 12 and 14, FIGS. 1 and 6, extend through aligned apertures 16 and 18 in the front cover, base, and back cover, FIG. 2, and thread into nuts 20 and 22, FIG. 6, seated in the back cover for mounting the front and back covers to the base. Terminals 24, 26, 28 and 30 are mounted to the base at one end thereof for electrical connection to a load device.

The invention encompasses two modes of operation, on delay and off delay. The embodiment providing on delay timing will be described first.

Figure 4:
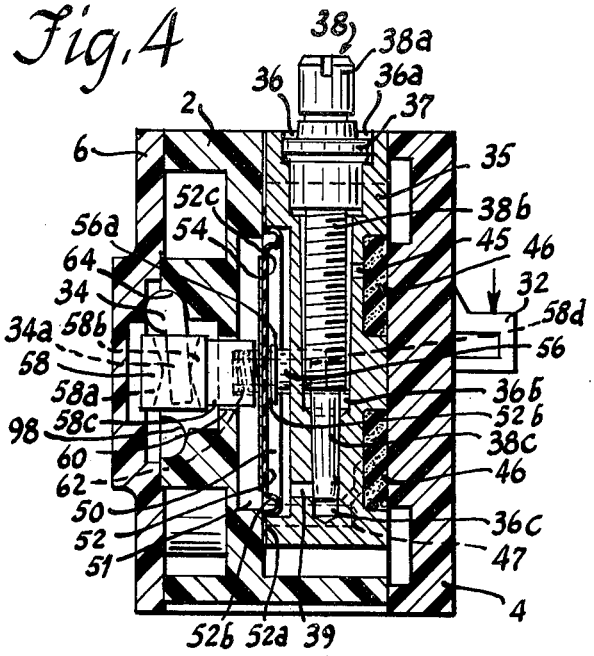
FIG. 4 is a cross-sectional view taken along line 4—4 on FIG. 2.
Figure 5:
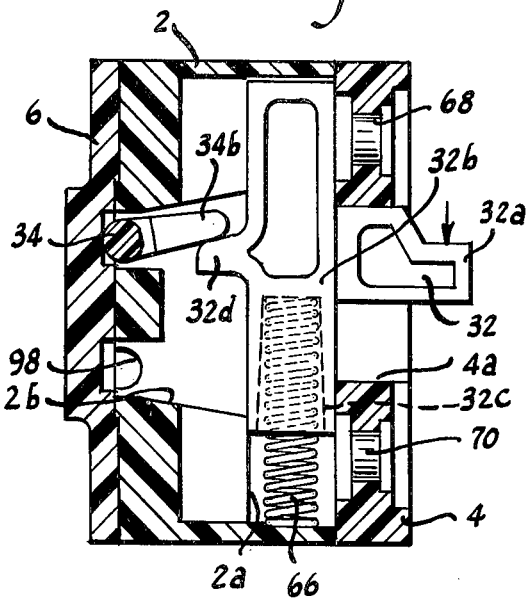
FIG. 5 is a cross-sectional view taken along line 5—5 of FIG. 2.
Figure 6:
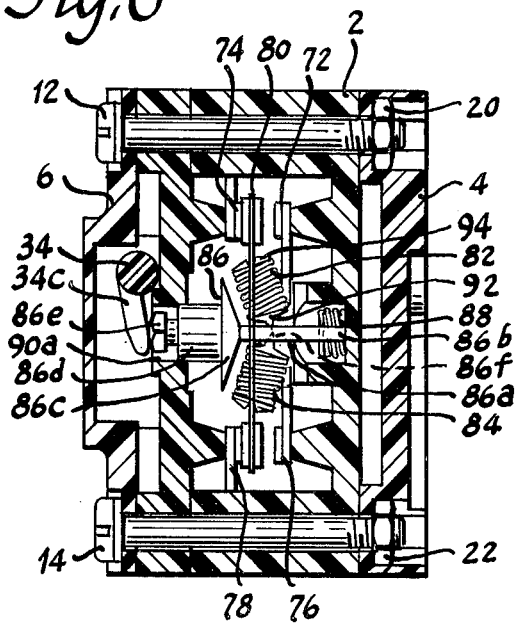
FIG. 6 is a cross-sectional view taken along line 6—6 of FIG. 2.

The base is divided into three compartments: a first compartment housing a diaphragm mechanism to provide pneumatic timing, FIG. 4; a second compartment housing a spring biased slidable push bar 32 for engagement by an external operator, FIG. 5; and a third compartment housing a snap-action bridging contact mechanism, FIG. 6. As shown in FIG. 2, an integral lever or camshaft 34 extends longitudinally with the base, traversing each compartment and providing means for interdependently relating one compartment's mechanism to the other compartment's mechanisms due to cams or camming tips extending transversely from the camshaft to engage the mechanisms in each compartment as seen FIG. 10.

As shown in FIG. 4, the first compartment houses a metal block 35 mounted therein by screws 8 and 10, FIG. 2, extending through apertures in the block and by screws 40 and 41 extending through aligned apertures 42 and 44, FIG. 2, in the front cover, base and block, and threaded into nuts (not shown) seated in the back cover. A stepped cylindraceous bore 36 extends downwardly into the block. This bore has an upper shouldered section **36*a* for air tightly seating a bushing 37, a middle slightly tapered section 36*b*, and a lower narrower slightly tapered section 36*c***.

Threaded through the bushing is an air metering pin 38 having an upper portion **38*a* extending externally of the base, a middle cylindrical portion 38*b* threaded through the bushing and partially into the middle section 36*b* of the bore, and a lower narrower slightly frusto-conical portion 38*c* wedgingly fitting into the lower section 36*c* of the bore. A small passageway 45 extends transversely from the middle section 36*b* of the bore into an annular filter 46 which is externally ventilated by another passageway 47 extending forwardly (leftwardly as seen in FIG. 4) through the block and the base and emerging adjacent screw 10, as shown in FIG. 2, thereby providing bore 36** with a source of external ventilation.

Another small passageway 39 extends transversely from the lower section **36*c* of the bore into a shallow saucer-shaped chamber 50 formed in block 35. This chamber is closed by a flexible rubber diaphragm 52 having a generally square outer periphery 52*a* sealed between the block and the base and mounted therebetween by screws 8, 10, 40 and 41. The diaphragm has an annular flexing bulge 52*b* adjacent the perimeter of chamber 50, an annular disk-shaped portion 52*c*, and a central aperture shouldered by an annular lip 52*d*. Lying flush against the disk-shaped portion is a flat annular metal disk 54 to thereby concentrate flexing of the diaphragm in the bulge 52*b***.

An elongated metal cap 56 extends through chamber 50 and is slidably seated at one end in a bore in the block for forward-rearward (leftward-rightward as seen in FIG. 4) movement and has an annular shoulder **56*a* at its other end abutting annular lip 52*d* of the diaphragm. Another chamber 51 is defined by the disk, diaphragm and base, and is externally ventilated by a passageway 49, FIG. 2, extending forwardly through the base and emerging between screws 8 and 10**.

Mounted in the base for forward-rearward reciprocal movement (left-right as seen in FIG. 4) is an integral squares-C-shaped hook member 58, the ends of the legs 58*a* and 58*b* of a squared-C shown in broken line in FIG. 4. Extending rearwardly from the exterior side of leg 58*b* and through a bushing 60 in the base is a cylindrical shank portion 58*c* having a smaller diametered stud portion 58*d* extending rearwardly therefrom slidably through the aligned central apertures in the disk and diaphragm into a threaded bore in cap 56 to provide securement thereto. Shank portion 58*c* overlaps stud portion 58*d* and is radially spaced therefrom to provide an annular clearance gap for receiving a helical compression spring 62 encircling stud portion 58*d* and bearing against the inner face of the shank portion at one end and against the metal disk at the other end to thereby bias the diaphragm against the cap, more specifically, annular lip 52*d* against annular shoulder 56*a*. The diameters of shoulder 56*a* and shank 58*c* are greater than the diameter of the aligned apertures in the disk and diaphragm.

Lever 34 rides in a semi-cylindrical groove 64 in the base, held therein by front cover 6, and has a camming tip 34*a* extending between the interior side faces and legs 58*a* and 58*b* to cause forward-rearward movement of the hook member and hence flexing of the diaphragm and contraction or expansion of chamber 50 upon rotation of lever 34, as will be more fully described hereinafter. It is to be noted that while chamber 51 is always maintained at atmospheric pressure due to passageway 49, chamber 50 may or may not be maintained at atmospheric pressure depending on whether spring 62 is biasing annular lip 52*d* to seal against shoulder 56*a*.

Referring to FIG. 4, clockwise rotation of lever 34 causes camming tip 34*a* to pull hook member 58 leftwardly which also pulls shoulder 56*a* sealingly against lip 52*d*. This motion also tends to increase the volume within chamber 50 and accordingly the pressure in chamber 50 will be less than the pressure in chamber 51. In order to equalize these pressures, external air is metered from passageway 47, through filter 46 and passageway 45 into bore 36, passageway 39 and chamber 50, with the rate thereof being controlled by metering pin 38, i.e. the amount of air per unit time entering chamber 50, due to the pressure drop therein, is limited by the constriction provided by the lower portion 38*c* of the metering pin being wedged into the lower section 36*c* of bore 36. It is thus possible to adjust the length of time delay before the lever reaches full clockwise rotation.

The foregoing operational description applies to the timing phase of an on delay timer. The reset phase is accomplished by counterclockwise rotation of lever 34 wherein camming tip 34*a* pushes hook member 58 rightwardly. This motion pushes shoulder 56*a* away from the diaphragm while spring 62 tends to decrease the volume in chamber 50 so that the pressure in chamber 50 is greater than the pressure in chamber 51. In order to equalize the pressures, air is expelled from chamber 50 almost instantaneously through the apertures in the disk and diaphragm into chamber 51 and hence to the atmosphere.

As shown in FIG. 5, the second compartment houses an operator which in the preferred embodiment is a spring biased slidable push bar 32 mounted for vertical reciprocal motion. This integral push bar has a portion 32*a* extending transversely from body portion 32*b* through an elongated rectangular aperture 4*a* in back cover 4 to allow operation thereof by an external mechanical force. Body portion 32*b* is mounted in an elongated rectangular slot 2*a* in the base and has a downwardly opening recess 32*c* for receiving a spring 66 biasing the push bar upwardly. Extending oppositely transversely from body portion 32*b* into a recess 2*b* in the base extending forwardly (leftwardly in FIG. 5) from recess 2*a* is a camming tip 32*d* arranged to engage camming tip 34*b* of lever 34. The back cover is provided with threaded inserts 68 and 70 for mounting the timer to an electromagnetic relay or the like. When the push bar moves to its extreme upward position due to the bias of spring 66, camming tip 32*d* will engage camming tip 34*b* and rotate lever 34 counterclockwise. When the push bar is moved to its extreme downward position, camming tip 32*d* is no longer in the arc of pivoting of camming tip 34*b* and lever 34 is free to rotate under the bias of biasing means in the third chamber, retarded however by the timing means in the first chamber, as will be more fully described hereinafter.

As shown in FIG. 6, the third compartment houses a snapaction bridging contact mechanism. Two sets of stationary contacts 72, 74 and 76, 78 are mounted to terminals 24, 26 and 30, 28 respectively as shown in FIGS. 2 and 6. These contacts are bridged by a thin movable metal contactor 80 having an outer elongated hexagonal shape and a central elongated generally rectangular aperture providing clearance for toggle springs 82 and 84 and actuator 86. The actuator is an integral member having a rear flat extended portion 86*a* having legs 86*b* (only one of which is shown in FIG. 6) projecting from the end thereof, in between which is a helical compression spring 88 bearing at one end against base 2 and at its other end against the rear portion 86*a*, seated thereagainst about a boss (not shown) extending therefrom parallel with and in between said legs, to thereby bias the actuator forwardly (leftwardly in FIG. 6).

The actuator further has a central annular ridge 86*c* which acts as a stop when it strikes an insert 90 rigidly mounted between the front cover 6 and the base 2 by screws 12 and 14. This insert has a bushing-like circular aperture 90*a* formed therein for slidably receiving upper cylindrical portion 86*d* and rounded camming head 86*c* of the actuator. Toggle spring 82 is mounted at one end to an elongated pointed head 92 which engages a notch 86*f* in the actuator and at the other end to a grooved head 94 which engages the inner edge of rectangularly apertured contactor 80. Toggle spring 84 is similarly mounted. Camming tip 34*c* is arranged for engagement by camming head 86*e* to cause clockwise rotation of lever 34 due to forward movement of actuator 86 under the bias of spring 88.

Operation of the on delay timer can now be described. An external mechanism, such as a movable member of an electromagnetic relay or the like, engages portion 32*a* to slide the push bar downwardly against the bias of spring 66. This releases camming tip 34*b* from its engagement with camming tip 32*d*, thus allowing lever 34 to rotate clockwise due to the bias of spring 88 acting through actuator 86 upon camming tip 34*c*. This clockwise rotation of lever 34 is retarded because leg 58*a* of hook member 58 limits the movement of camming tip 34*a*. Lever 34 rotates slowly while the volume in chamber 50 increases, the rate thereof determined by adjustment of metering pin 38. When the lever has rotated enough to allow actuator 86 to move overcenter, the toggle springs cause the contactor 80 to snap to its alternate position, closing an electrical circuit. As shown in FIG. 1, clockwise rotation of pin 38 will lengthen the time delay by turning the screw further into block 35 to thereby further contrict bore 36 at its lower section 36c due to the frusto-conical shapes of section 36c and lower pin portion 38c.

Upon release of push bar 32, camming tip 32d engages camming tip 34b, thereby rotating lever 34 counterclockwise whereby camming tip 34c moves actuator 86 rightwardly, as seen in FIG 6, the bias of spring 66 being greater than the bias of spring 88. There is minimum delay in the return over-center travel of the actuator because rightward movement of hook member 58, as seen in FIG. 4, is not retarded due to expulsion of air from chamber 50 into chamber 51 through the apertures in the disk and the diaphragm following seaparation of annular shoulder 56a from the diaphragm. The embodiment described typically has a timed on delay with an adjustable range of 0.2 to 60 seconds and a maximum reset time of 0.1 seconds.

Figure 7:
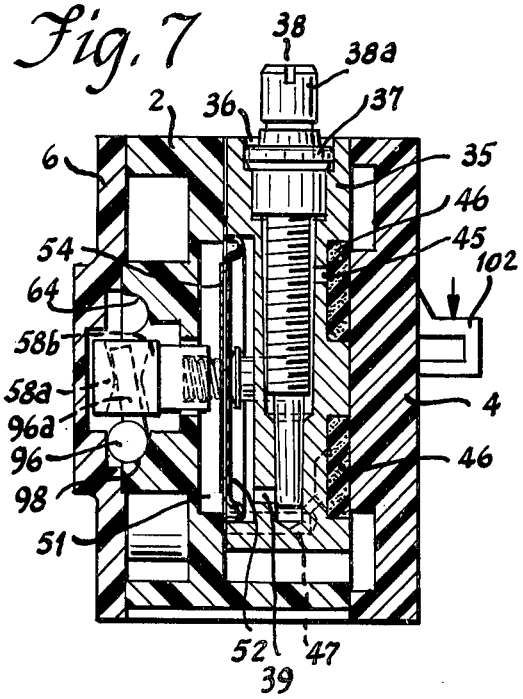
FIG. 7 is a view like FIG. 4 but showing an "off delay" timing mode.
Figure 8:
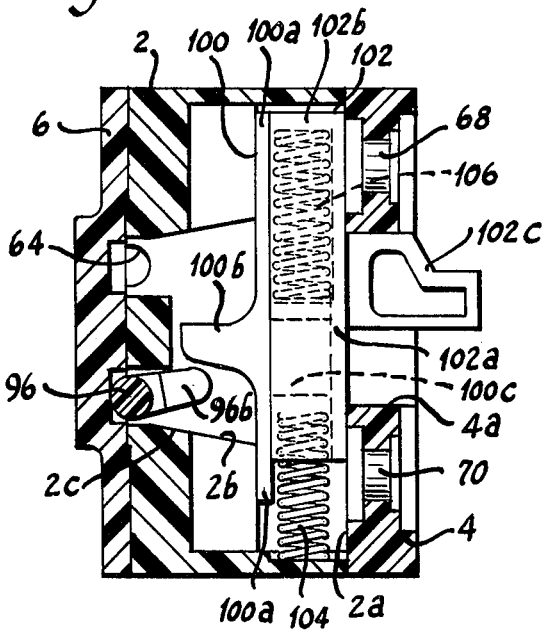
FIG. 8 is a view like FIG. 5 but showing an off delay timing mode.
Figure 10:
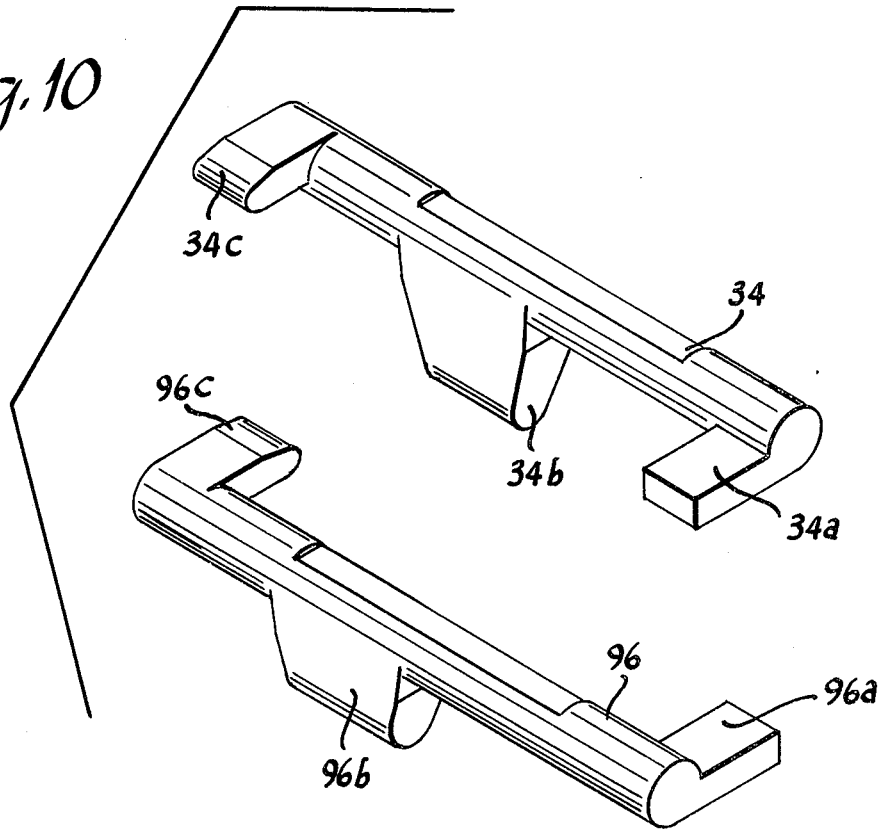
FIG. 10 is a view of an "on delay" lever and an off delay lever.

An off delay timer is also disclosed and is substantially similar to the aforedescribed on delay timer in many of its structural details, therefore only the differences therebetween will be described. As shown in FIG. 10, there is provided an integral lever or camshaft 96, similar to lever 34 but having differently oriented camming tips. As shown in FIG. 2, the base is provided with a semi-cylindrical groove 98 for carrying lever 96, similar to groove 64 carrying lever 34. As seen in FIG. 7, lever 96 rides in groove 98 and has a camming tip 96a extending between the interior side faces of legs 58a and 58b of hook member 58. As shown in FIG. 8, former push bar 32 is now divided into two pieces, slider member 100 and over-travel member 102, slidable relative to one another and to base 2. Over-travel member 102 has an inverted L-shape having an elongated vertical leg 102a slidable along the rear wall of slot 1a in the base and a shorter horizontal leg 102b extending forwardly from the top of leg 102a. Extending rearwardly from the central part of leg 102a through aperture 4a in the back cover is a portion 102c for external engagement.

Figure 9:
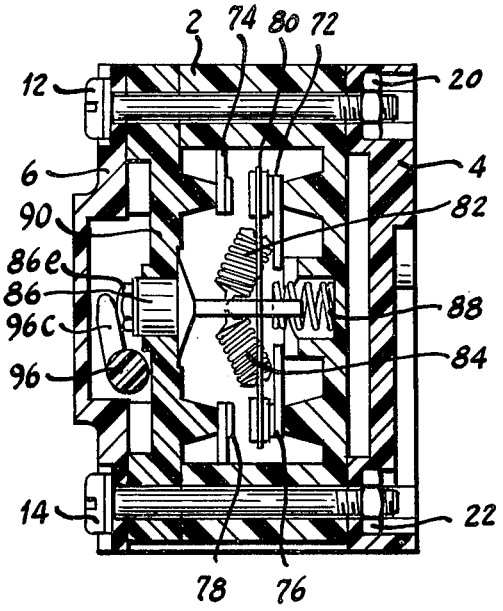
FIG. 9 is a view like FIG. 6 but showing an off delay timing mode.

Slider member 100 is generally cross-shaped having an elongated vertical portion 100a slidable along the front wall of slot 2a in the base, a camming tip 100b extending forwardly therefrom into recess 2b in the base for engagement with camming tip 96b of lever 96, and a spring-mounting portion 100c (shown in broken line in FIG. 8) extending rearwardly therefrom. A helical compression spring 104 bears at its lower end against the bottom wall of slot 2a in the base and at its upper end against portion 100c of the slider member. Another helical compression spring 106, having a greater tension rating than spring 104 and mounted colinearly therewith, bears at its lower end against portion 100c and at its upper end against leg 102b. As seen in FIG. 9, camming tip 96c of the lever is arranged for engagement with rounded camming head 86e of the actuator.

Operation of the off delay timer can now be described. Downward sliding of over-travel member 102 by an external force causes downward sliding of slider member 100 and compression of spring 104. After camming tip 100b pivots camming tip 96b against stop 2c, FIG. 8, in the base, slider member 100 stops its downward movement and spring 106 compresses to allow over-travel member 102 to continue its downward movement until portion 102c reaches the bottom of aperture 4a in the back cover or until the external operator reaches the end of its travel stroke. Downward movement of the over-travel and slider members cause clockwise rotation of lever 96, which translates into rightward movement of hook member 58, as seen in FIG. 7, and, as aforedescribed, rightward movement of the hook member is not substantially retarded, thus allowing actuator 86 to be cammed by camming tip 96c, FIG. 9, to an over-centered position without a time delay.

Upon release of over-travel member 102, camming tip 100b releases camming tip 96b allowing lever 96 to rotate counterclockwise under the bias of spring 88. This counterclockwise rotation is retarded, however, by the mechanism in the first compartment, as aforedescribed, thereby delaying over-center toggling of actuator 86. The adjustment range and reset time are comparable to the on delay timer.

We claim:

1. A timing device comprising:

a housing:

a lever mounted in said housing for rotational movement about its longitudinal axis and having a plurality of cams extending transversely therefrom;

an actuator mounted in said housing for reciprocal movement and having a portion engaging a first of said cams;

biasing mans biasing said lever in one direction of rotation thereof;

an operator movably mounted in said housing and having a camming tip engageable with a second of said cams such that in one direction of movement of said operator, said camming tip disengages said second cam to allow said lever to rotate under the bias of said biasing means and such that in the opposite direction of movement of said operator, said camming tip engages said second cam to rotate said lever against the bias of said biasing means;

pneumatic time delay means mounted in said housing and having a movable timing head in engagement with a third of said cams to adjustably retard the rate of rotation of said lever under the bias of said biasing means; and switch means mounted in said housing for effecting switching operations in response to a predetermined amount of movement of said actuator corresponding to a predetermined amount of rotation of said lever.

2. A timing device according to claim 1 wherein said pneumatic time delay means comprises:

a block having a recess and a passageway externally ventilating said recess;

a flexible diaphragm enclosing said recess to define a chamber with said block;

a metering pin adjustably constricting said passageway to thereby control the rate of air flow into said chamber;

one way valve means attached to said timing head and communicating with said chamber such that movement of said timing head under the bias of said biasing means acting through said lever closes said valve means and flexes said diaphragm to expand said chamber, the rate thereof being controlled by said metering pin, and such that movement of said timing head against the bias of said biasing means acting through said lever opens said valve means and flexes said diaphragm to contract said chamber substantially instantaneously by expulsion of air through said valve means.

3. A timing device according to claim 1 wherein said operator comprises a return spring biased slidable push bar normally engaging said second cam to prevent rotation of said lever.

4. A timing device according to claim 1 wherein said operator comprises a biased slider member normally disengaging said second cam and a biased over-travel member slidably engaging said slider member.

5. A timing device according to claim 1 wherein said switch means comprises a snap-action toggle contacting mechanism having a center unstable position travelled through by said actuator.

* * * * *